US005265878A

United States Patent [19]

Kim

[11] Patent Number: 5,265,878

[45] Date of Patent: Nov. 30, 1993

[54] COLOR ASSOCIATION GAME APPARATUS

[76] Inventor: Jun Y. Kim, 4933 Todd Ave., Apt. E, Baltimore, Md. 21206

[21] Appl. No.: 967,420

[22] Filed: Oct. 28, 1992

[51] Int. Cl.[5] ..... A63F 3/00

[52] U.S. Cl. ..... 273/237; 273/264; 273/271

[58] Field of Search ..... 273/237, 238, 243, 264, 273/268, 269, 270, 271, 273, 276; 434/118, 128, 129, 168, 169, 176, 333, 338, 339, 360, 359, 365, 340

[56] References Cited

U.S. PATENT DOCUMENTS

| | | | |
|---|---|---|---|
| 3,367,663 | 2/1968 | Marks | 273/237 |
| 4,139,199 | 2/1979 | Drummond | 273/243 |
| 4,335,879 | 6/1982 | Wisker | 273/243 X |
| 4,607,847 | 8/1986 | Chung | 273/264 |
| 4,700,951 | 10/1987 | Lachenmeier | 273/264 |
| 4,863,172 | 9/1989 | Rosenwinkel et al. | 273/237 X |
| 4,907,807 | 3/1990 | Lee et al. | 273/243 X |
| 5,064,201 | 11/1991 | Smith | 273/264 X |

FOREIGN PATENT DOCUMENTS

| | | | |
|---|---|---|---|
| 2013505 | 8/1978 | United Kingdom | 273/264 |

*Primary Examiner*—William Stoll
*Attorney, Agent, or Firm*—Leon Gilden

[57] ABSTRACT

A game board includes a perimeter continuous game path having a plurality of categories of directional spaces therewithin to direct players to effect the removal, reversal, replacement, or selection of various coloration discs from a quantity of such discs to provide for the duplication of a pattern upon a central section of position squares to duplicate a pattern from a directional card afforded each player. Boxes of squares are positioned adjacent the exterior of the central section, whereupon individual players may duplicate various patterns of the central section to permit removal of discs therefrom to alter plans of opposing players in completion of a predetermined pattern of discs.

2 Claims, 4 Drawing Sheets

FIG. 8
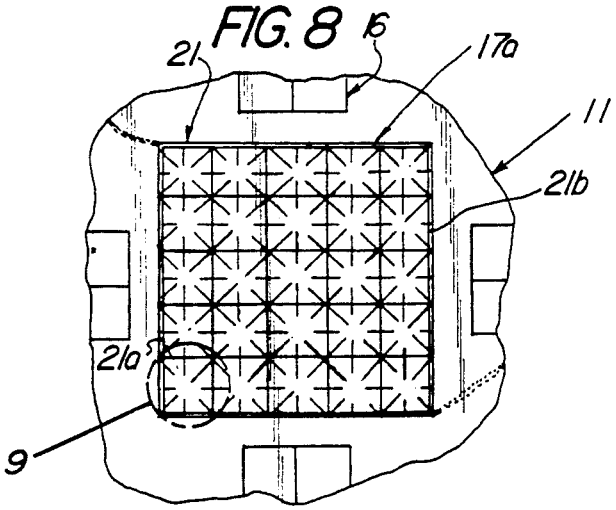
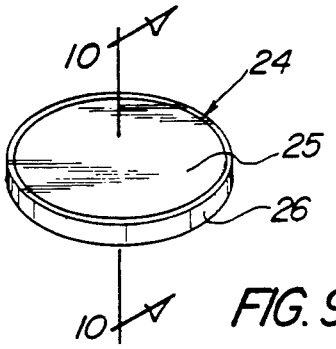
FIG. 9A
FIG. 9
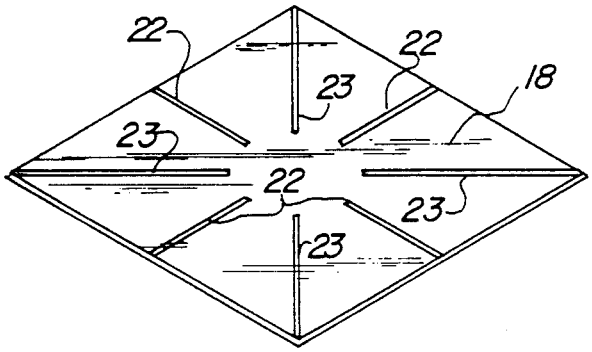
FIG. 10
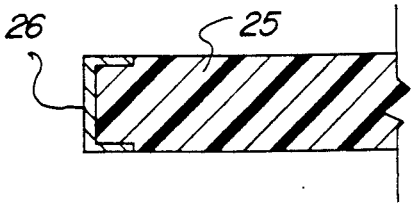

COLOR ASSOCIATION GAME APPARATUS

BACKGROUND OF THE INVENTION

1. Field of the Invention

The filed of invention relates to game apparatus, and more particularly pertains to a new and improved color association game apparatus wherein the same is arranged to effect the completion of a predetermined pattern of color discs relative to a game board central section.

2. Description of the Prior Art

Game apparatus of various types are utilized throughout the prior art for the entertainment and amusement of individuals and such games are exemplified in the U.S. Pat. Nos. 4,884,819; 4,955,617; 4,927,145; and 4,966,371.

The games of the prior art have been availed for various categories of play, wherein the instant invention attempts to provide for a game apparatus of entertainment and amusement value in a manner not addressed by the prior art and in this respect, the present invention substantially fulfills this need.

SUMMARY OF THE INVENTION

In view of the foregoing disadvantages inherent in the known types of game apparatus now present in the prior art, the present invention provides a color association game apparatus wherein the same is arranged to direct individual players to attempt to duplicate patterns of preselected patterns upon a game board. As such, the general purpose of the present invention, which will be described subsequently in greater detail, is to provide a new and improved color association game apparatus which has all the advantages of the prior art game apparatus and none of the disadvantages.

To attain this, the present invention provides a game board including a perimeter continuous game path having a plurality of categories of directional spaces therewithin to direct players to effect the removal, reversal, replacement, or selection of various coloration discs from a quantity of such discs to provide for the duplication of a pattern upon a central section of position squares to duplicate a pattern from a directional card afforded each player. Boxes of squares are positioned adjacent the exterior of the central section, whereupon individual players may duplicate various patterns of the central section to permit removal of discs therefrom to alter plans of opposing players in completion of a predetermined pattern of discs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved color association game apparatus which has all the advantages of the prior art game apparatus and none of the disadvantages.

It is another object of the present invention to provide a new and improved color association game apparatus which may be easily and efficiently manufactured and marketed.

It is a further object of the present invention to provide a new and improved color association game apparatus which is of a durable and reliable construction.

An even further object of the present invention is to provide a new and improved color association game apparatus which is susceptible of a low cost of manufacture with regard to both materials and labor, and which accordingly is then susceptible of low prices of sale to the consuming public, thereby making such color association game apparatus economically available to the buying public.

Still yet another object of the present invention is to provide a new and improved color association game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic view of a modified central section portion as employed by the invention.

FIG. 9 is an enlarged isometric illustration of section 9 as set forth in FIG. 8.

FIG. 9*a* is an isometric illustration of a color disc utilized by the invention.

FIG. 10 is an orthographic view, taken along the lines 10—10 of FIG. 9*a* in the direction indicated by the arrows.

DESCRIPTION OF THE PREFERRED EMBODIMENT

Figure 1:
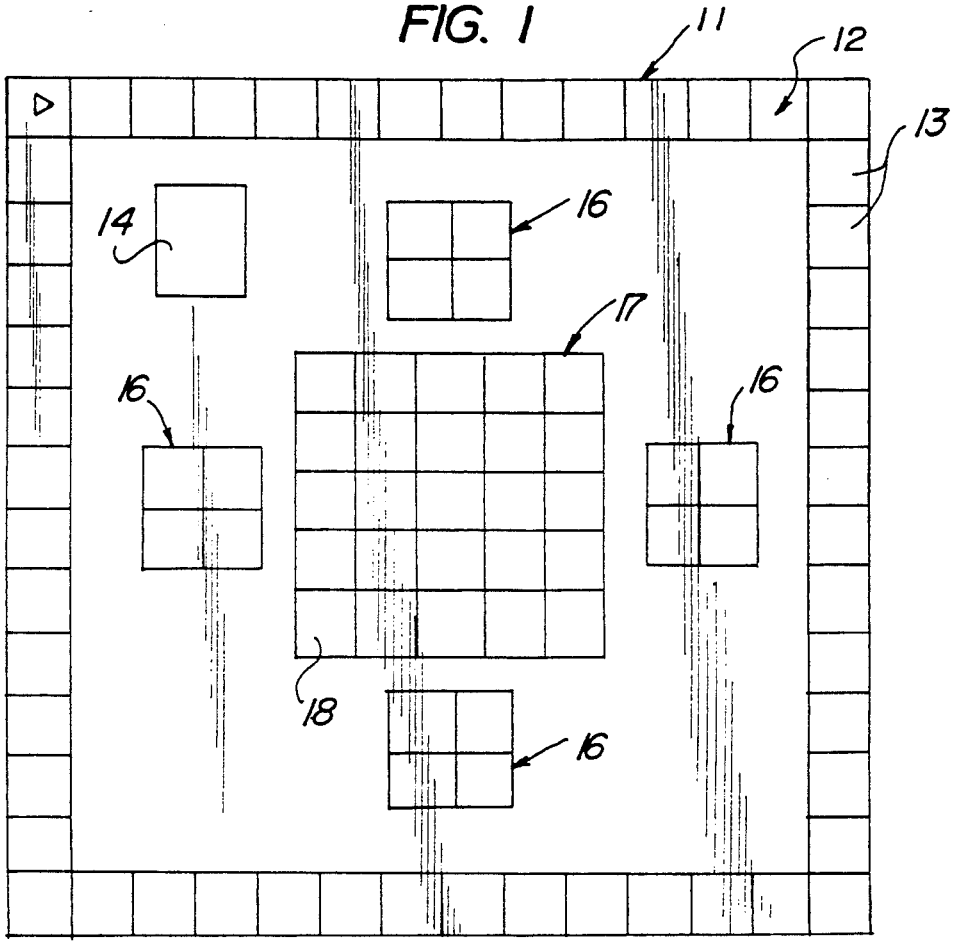
FIG. 1 is an orthographic view of the game board of the invention.

With reference now to the drawings, and in particular to FIGS. 1 to 12 thereof, a new and improved color association game apparatus embodying the principles and concepts of the present invention and generally designated by the reference numerals 11–32 will be described.

Figure 2:
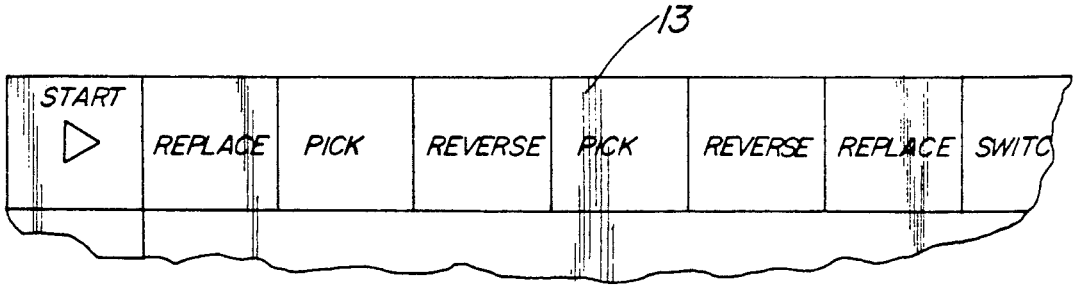
FIG. 2 is an enlarged orthographic view of game spaces of the continuous path of the game board.
Figure 3:
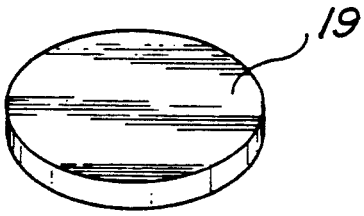
FIG. 3 is an isometric illustration of a token member utilized by the invention relative to each player.
Figure 4:
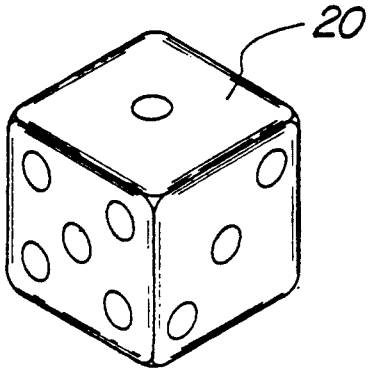
FIG. 4 is a die member utilized to direct tokens about the continuous path.
Figure 5:
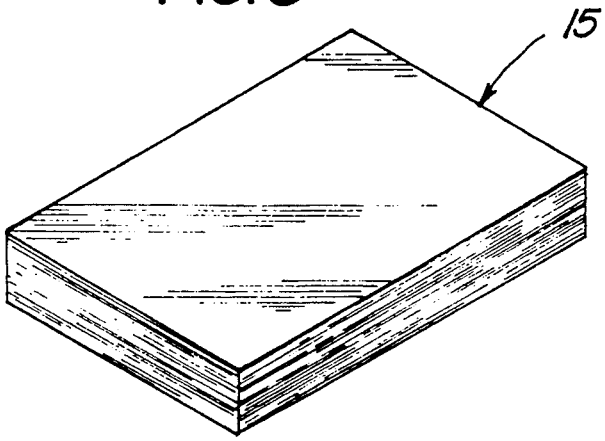
FIG. 5 is an isometric illustration of a stack of directional cards utilized by the invention.
Figure 6:
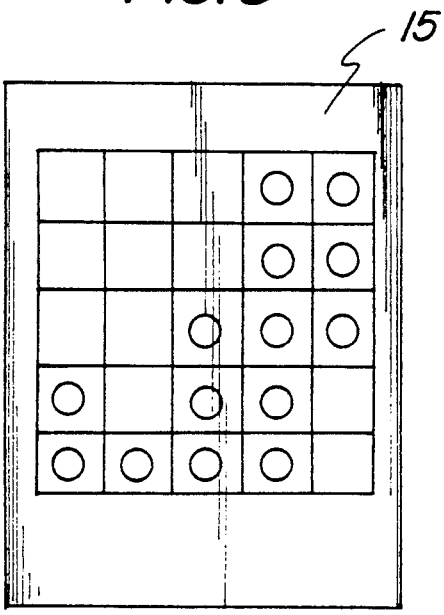
FIG. 6 and FIG. 7 are orthographic views of examples of directional cards and their patterns indicated for use by the invention.
Figure 7:
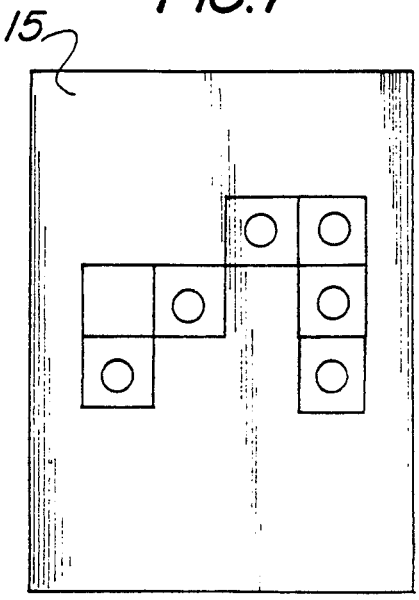
Figure 11:
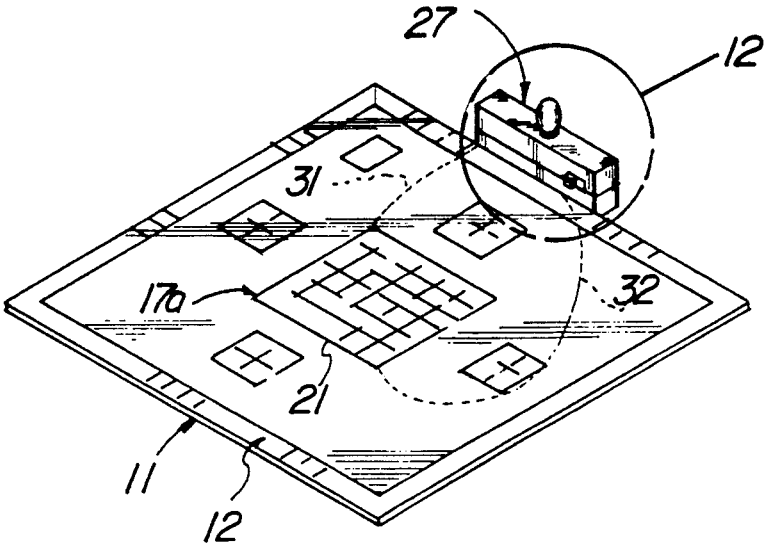
FIG. 11 is an isometric illustration of a modified game board structure having an indicator housing.
Figure 12:
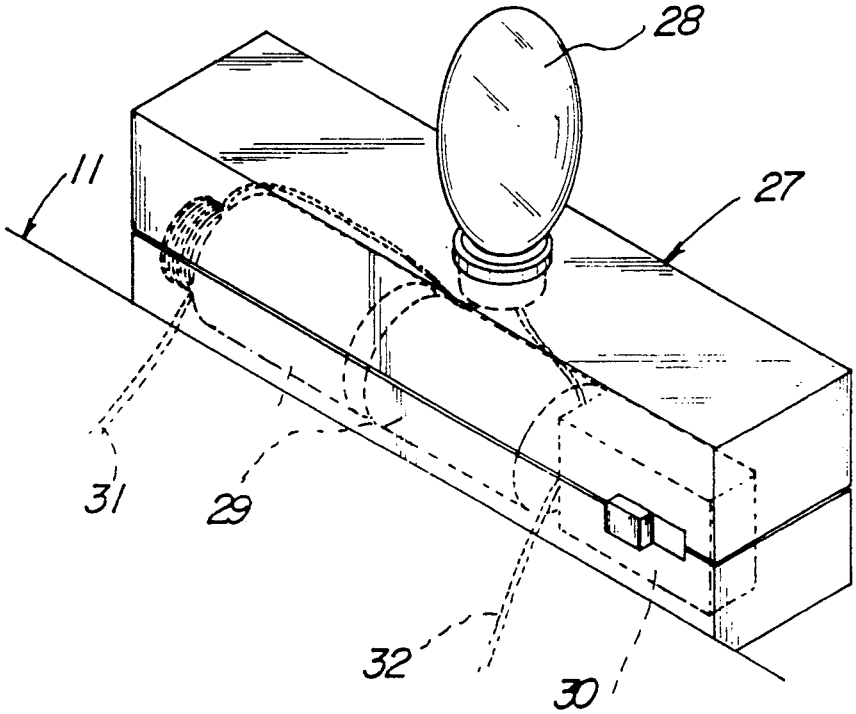
FIG. 12 is an enlarged isometric illustration of the indicator housing of the invention.

More specifically, the color association game apparatus of the invention comprises a game board 11 having a continuous path 12 directed about a perimeter of the game board. The game path 12 includes a plurality of directional spaces 13 of a plurality of categories. The categories include a "start space", a plurality of "replace" spaces, a plurality of "pick" spaces, a plurality of "reverse" spaces, and a plurality of "switch" spaces. The spaces and their association with components of the game board will be described in more detail below. A directional card stack space 14 is provided upon the game board 11 within the game path 12 to receive a stack of directional cards 15. Each of the directional cards 15 includes a pattern such as indicated in FIGS. 6 and 7 for utilization with a central section 17. The central section 17 includes an equal predetermined number of rows and columns of position squares 18. Two to four players are involved in play of the game and accordingly, four game tokens 19 are provided in association with the die member 20 to direct movement of the game tokens 19 about the game path 12. Each side of the central section 17 of a square configuration includes a power box matrix 16, each of a square of box members. Further, a predetermined number of color discs 24 are provided, of a type as indicated in FIG. 9*a*. The color discs typically number an arbitrary number, but are arranged to include one hundred and eight discs. The discs are arranged to have a top side and a bottom side, with the top side and bottom side of colorations to include colorations of six contrasting colorations, such as red, blue, yellow, violet, green, and orange. One hundred five of the hundred eight discs include various color combinations, to further include three virus discs that are black on both sides. In play of the game, a player picks a card of the directional cards 15. The object is for each player to match utilizing the color discs 24, the pattern imparted upon the card such as indicated in FIGS. 6 and 7 within the central section 17 of the position squares 18. Each player upon determining order of play, such as by rolling the die, to associate a player initiating play with the greatest number rolled by the die member 20, effects movement from the start space to one of the spaces such as indicated in FIG. 2. The "replace" spaces indicate that a disc on the board of the central section 17 is removed by a moving player and another substitute disc is selected from a stack of the discs such as from within a bag and the like, and replaced onto the coin to accordingly afford that player's designated pattern. The "pick" spaces indicates that the moving player must select one additional directional card 15 and thereby obtain more opportunities to complete a predetermined pattern of examples as indicated in FIGS. 5 and 6. The use of the "switch" spaces indicates that the moving player must switch two discs of the colored discs 24 that are on the central section 17 to thereby afford opportunity to complete a predetermined pattern as required by the directional cards 15. The "reverse" spaces indicates the moving player must reverse a color disc on the board to reverse the top side versus the bottom side to thereby potentially indicate a contrasting color as the color discs may be formed of contrasting colors relative to the top side and bottom side of each color disc. The game path 12 may further include a "select" space, wherein upon landing upon such a space, a player is to select an additional directional card 15 for additional pattern to be completed. An additional directional card 15 is also selected upon a player completing a complete traverse of the path 12, whereupon landing upon or exceeding upon the start space, an additional directional card 15 is selected.

The three virus discs of black coloration when selected are positioned upon the central section 17 to thereby thwart completion of patterns of opposing players. It should be understood that patterns indicated, such as in FIGS. 5 and 6, are not only in pattern but in coloration to be matched, whereupon each of the representative discs upon a directional card is also of a distinct coloration to thereby complete not only a geometric pattern configuration but the associated colors therewith.

The power boxes 16 are utilized by each of the players, whereupon the players may in lieu of positioning a color disc upon the central section 17, position such a disc upon the player's power box, whereupon the power box may upon completion of a predetermined pattern thereon within the four spaces permit the moving player to remove the color disc positioned on the power box, as well as to that player's discretion remove color discs 24 from the central section 17 of a like pattern and coloration to thereby thwart opposing player's completion of their pattern goals, as well as permit the removal of the virus discs from the moving player's portion of the central section and permit a moving player to thereby remove unwanted discs from the central section 17 and the associated spaces 18. A player to complete a pattern of desired configuration and coloration first is declared a winner.

The FIG. 8 indicates the use of a modified central section 17 having the use of the position squares 18 to include first electrical strips 22 directed orthogonally toward a central portion of each central section from each side of the position square 18, with second electrical strips 23 radially directed into the respective position square 18 from each corner of each position square. In this manner, a plurality of radially directed electrical strips 22 and 23 are directed into the medial portion of each position square 18, whereupon each color disc 24 is arranged to include an electrical conductive disc circumferential band 26 relative to each central colored hub 25. As is noted, the central hub 25 may include a top and bottom surface of contrasting or light colorations of a predetermined number of colorations such as six colorations as noted above. The modified central section 17*a* accordingly includes a perimeter electrical conductive strip 21 having a first segment 21*a* separated from a second segment 21*b*. A further object accordingly is to effect electrical communication between the first segment 21*a* and the second segment 21*b* by electrical communication through the position squares 18, whereupon positioning of a color disc 24 upon a position square 18, electrical communication utilizing the first and second electrical strips 22 and 23 permits electrical communication between the first and second segments 21*a* and 21*b*. To this end, an indicator housing 27 is provided having an illumination bulb 28 thereon, to include battery members 29 cooperative with an on/off switch 30, wherein a first electrical conduit wire 31 is directed into the first segment 21*a*, with a second electrical conduit wire 32 directed into the second segment 21*b*. Upon effecting electrical communication between the first and second segments and the switch 30 in the on position, the illumination bulb 28 is illuminated to indicate completion of pattern upon completion of the direct current circuitry between the first and second segments 21*a* and 21*b* effecting illumination of the illumination bulb 28.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A color association game apparatus, comprising, a game board, with the game board including a game board perimeter edge, and a continuous game path extending about the game board in adjacency to the game board perimeter edge, with the game path having a plurality of directional spaces to include a first category, a second category, a third category, a fourth category, and a fifth category, with a directional card stack space positioned on the game board interiorly of the path, and a stack of directional cards positioned on the directional card stack space, with each of the directional cards having a pattern imposed thereon, wherein each pattern includes a plurality of representative position squares, with at least some position squares having a representation of a color disc printed thereon, and the apparatus including a plurality of color discs associated with the printed representations of the color discs, and a central section of said game board having an equal predetermined number of rows and columns of position squares, with each position square arranged to receive one of the color discs in association with the pattern indicated by one of said directional cards, at least one of the directional spaces including instructions to direct players to select color discs from said color discs and position the color discs within the central section, and a plurality of tokens with one of said tokens associated with each of said players, and each of the tokens positioned upon the game path, and a chance member arranged to direct play along the path, with at least one of the directional spaces including instructions to direct the players to position the discs upon the central section as indicated by the directional spaces, and the first category of spaces includes a start space, the second category includes a plurality of replace spaces, wherein each of the replace spaces directs a player to remove one of the discs from the central section and replace such disc with a further color disc from said plurality of color discs, the third category of spaces includes a plurality of switch spaces to switch a plurality of said color discs positioned upon the central section, and the fourth category of spaces includes a plurality of reverse spaces to indicate a player to reverse a color disc upon an associated position square of the central section, and the fifth category of spaces includes a plurality of pick spaces to direct selection of an additional directional card from said stack of directional cards, and the central section includes an outer perimeter conductive strip to include a first segment and a second segment in electrical insulation relative to one another, with each of the position squares within the central section including first electrical conductive strips and second electrical conductive strips, and each color disc includes a circumferential electrically conductive band to effect electrical communication of the first and second electrical strips within each central section, with each of the first and second electrical strips extending from a perimeter edge of each position square towards a medial portion of each position square.

2. An apparatus as set forth in claim 1 including an indicator housing, with the indicator housing having an illumination bulb, at least one battery member, and an on/off switch, and the first segment having a first electrical conduit wire directed from the first segment to the at least one battery member, and a second electrical conductive strip directed from the at least one battery member through the switch to the second segment, whereupon positioning of the color discs on the central section and completion of electrical communication between the first segment and the second segment effects illumination of the illumination bulb.

* * * * *